US010954017B2

(12) United States Patent
Kato

(10) Patent No.: US 10,954,017 B2
(45) Date of Patent: Mar. 23, 2021

(54) PACKAGING MACHINE AND SEALING METHOD IN PACKAGING MACHINE

(71) Applicants: GENERAL PACKER CO., LTD., Aichi (JP); Kazuki Kato, Kitanagoya (JP)

(72) Inventor: Kazuki Kato, Kitanagoya (JP)

(73) Assignee: GENERAL PACKER CO., LTD., Aichi (JP)

( * ) Notice: Subject to any disclaimer, the term of this patent is extended or adjusted under 35 U.S.C. 154(b) by 192 days.

(21) Appl. No.: 16/310,078

(22) PCT Filed: May 16, 2017

(86) PCT No.: PCT/JP2017/018306

§ 371 (c)(1),
(2) Date: Dec. 14, 2018

(87) PCT Pub. No.: WO2017/217167

PCT Pub. Date: Dec. 21, 2017

(65) Prior Publication Data

US 2019/0329922 A1 Oct. 31, 2019

(30) Foreign Application Priority Data

Jun. 15, 2016 (JP) ..... JP2016-118471

(51) Int. Cl.
*B65B 51/22* (2006.01)
*B65B 7/02* (2006.01)
(Continued)

(52) U.S. Cl.
CPC ..... *B65B 51/225* (2013.01); *B65B 7/02* (2013.01); *B65B 31/06* (2013.01); *B65B 51/32* (2013.01)

(58) Field of Classification Search
CPC ..... B65B 7/02; B65B 7/06; B65B 25/001; B65B 25/041; B65B 31/041;
(Continued)

(56) References Cited

U.S. PATENT DOCUMENTS 3,182,432 A * 5/1965 Canfield ..... B65B 31/06 53/512
4,081,942 A * 4/1978 Johnson ..... B65B 7/06 53/407
(Continued)

FOREIGN PATENT DOCUMENTS

CN 104943898 A 9/2015
EP 0792735 A1 * 9/1997 ..... B65B 51/225
(Continued)

OTHER PUBLICATIONS

International Search Report and Written Opinion for PCT Patent App. No. PCT/JP2017/018306 (dated Jul. 18, 2017) with English translation of the ISR.
(Continued)

*Primary Examiner* — Stephen F. Gerrity
(74) *Attorney, Agent, or Firm* — Cermak Nakajima & McGowan LLP; Tomoko Nakajima

(57) ABSTRACT

Providing a packaging machine and a sealing method in the packaging machine both of which can reliably seal a packaging bag in a good-looking finish without forming large bubbles on a seal inner surface of a bag mouth of the packaging bag and/or creases on a seal part.
A packaging machine includes a seal part preheating station for preheating a seal part of a packaging bag after the packaging bag has been filled with an article and steam deaeration has been carried out, a decorative seal applying station provided downstream of the seal part preheating station for applying a decorative seal to a part of the packaging bag above the seal part and an ultrasonic seal
(Continued)

applying station provided downstream of the decorative seal applying station for applying an ultrasonic seal to a part of the packaging bag A below the seal part.

5 Claims, 9 Drawing Sheets

(51) Int. Cl.
*B65B 31/06* (2006.01)
*B65B 51/32* (2006.01)

(58) Field of Classification Search
CPC ... B65B 31/042; B65B 31/044; B65B 31/046; B65B 31/048; B65B 31/06; B65B 43/465; B65B 43/60; B65B 51/146; B65B 51/225; B65B 51/32; Y10S 53/02
USPC ... 53/403, 407, 434, 469, 479, 79, 110, 512, 53/284.7, 375.3, 374.8, DIG. 2
See application file for complete search history.

(56) References Cited

U.S. PATENT DOCUMENTS 4,306,400 A * 12/1981 Coleman et al. ..... B65B 51/146 53/374.5
4,418,513 A * 12/1983 Plahm ..... B65B 31/042 53/373.2
8,245,485 B2 8/2012 Fukeda et al.
8,366,855 B2 * 2/2013 Murray ..... B65B 3/04 156/252
2004/0025474 A1 * 2/2004 Hiramoto ..... B29C 65/08 53/434
2005/0271306 A1 * 12/2005 Murray ..... B65B 51/146 383/38
2006/0196784 A1 * 9/2006 Murray ..... B65B 43/465 206/219
2010/0018160 A1 1/2010 Fukeda et al.
2012/0210675 A1 8/2012 Murray et al.
2014/0352253 A1 * 12/2014 Yamamoto et al. ..... B65B 51/225 53/76
2015/0274336 A1 10/2015 Kaneko

FOREIGN PATENT DOCUMENTS

EP 2147774 A1 1/2010
EP 2933198 A1 10/2015
JP 10024908 A * 1/1998 ..... B29C 65/08
JP 2010-023887 A 2/2010
JP 2010-030601 A 2/2010
JP 2015-182806 A 10/2015
JP 2016216097 A * 12/2016
KR 10-2015-0111847 A 10/2015

OTHER PUBLICATIONS

English translation of Official Action from Russian Patent App. No. 2019100565 (dated Apr. 27, 2020).
Notification of Reasons for Refusal from Japanese Patent App. No. 2016-118471 (dated Dec. 23, 2019) with English translation thereof.
Office Action from Polish Patent App. No. P.428887 (dated Aug. 6, 2020) with partial English language translation thereof.

* cited by examiner

PACKAGING MACHINE AND SEALING METHOD IN PACKAGING MACHINE

This application is a national phase entry under 35 U.S.C. § 371 of PCT Patent Application No. PCT/JP2017/018306, filed on May 16, 2017, which is incorporated by reference.

TECHNICAL FIELD

The present invention relates to a packaging machine which fills a packaging bag with an article to be packaged, such as food, and thereafter seals a bag mouth and to a sealing method in the packaging machine.

BACKGROUND ART

Ultrasonic sealing techniques have been conventionally introduced into retort pouch packaging machines in order to reduce bag breakage due to biting into products or the like. More specifically, steam deaeration is carried out after a packaging bag has been filled with an article such as food in these types of retort pouch packaging machines. A seal part B of a packaging bag A as illustrated in FIG. 9 is then preheated, and an ultrasonic seal C is applied to a lower transverse part of the seal part B. A decorative seal D (or cosmetic seal) is further applied to a part above the ultrasonic seal C. The bag mouth is thus sealed in the above-described process sequence (Japanese Patent Application No. 2015-103496) (published as JP 2016-216097 A).

However, since the packaging bag A is filled with steam for deaeration, water drops adhere to an inner surface of the seal part B of the bag mouth, with the result that the preheating seal carried out for the seal part B after deaeration cannot completely vaporize the waterdrops adherent to the inner surface of the seal part B. When the ultrasonic seal C is applied under the above-described condition, the ultrasonic seal C blocks escape routs of the waterdrops adherent to the inner surface of the seal part B. As a result, large bubbles are formed on the inner surface of the decorative seal D when the decorative seal (or the cosmetic seal) D is thereafter applied. Although the large bubbles can be collapsed when the seal part B is cooled in a seal cooling step after application of the decorative seal D, a problem arises that creases are formed in the seal part.

PRIOR ART DOCUMENT

Patent Documents

Patent Document 1: Japanese Patent Application No. 2015-103496 (published as JP 2016-216097 A)

SUMMARY OF THE INVENTION

Problem to be Overcome by the Invention

An object of the present invention is to provide a packaging machine and a sealing method in the packaging machine, both of which can reliably seal the packaging bag in a good-looking finish without forming large bubbles on the seal inner surface of the bag mouth of the packaging bag and/or creases on the seal part.

Means for Overcoming the Problem

To achieve the object, the invention provides a packaging machine in which a packaging bag is intermittently moved to each packaging station together with a mover so that an article is packaged. The packaging machine includes a seal part preheating station for preheating a seal part of the packaging bag after the packaging bag has been filled with the article and steam deaeration has been carried out, a decorative seal applying station provided downstream of the seal part preheating station for applying a decorative seal to a part of the packaging bag above the seal part, and an ultrasonic seal applying station provided downstream of the decorative seal applying station for applying an ultrasonic seal to a part of the packaging bag below the seal part. The packaging machine may further include a cooling station provided downstream of the ultrasonic seal applying station for cooling the seal part of the packaging bag.

To achieve the object, the invention also provides a sealing method in a packaging machine in which a packaging bag is intermittently moved to each packaging station together with a mover so that an article is packaged. The sealing method includes a seal part preheating step of preheating a seal part of the packaging bag after the packaging bag has been filled with the article and steam deaeration has been carried out, a decorative seal applying step of applying a decorative seal to a part of the packaging bag above the seal part after the seal part preheating step, and an ultrasonic seal applying step of applying an ultrasonic seal to a part of the packaging bag below the seal part after the decorative seal applying step. The sealing method may further include a cooling step of cooling the seal part of the packaging bag after the ultrasonic seal applying step.

Effect of the Invention

The packaging machine can reliably seal the packaging bag in a good-looking finish without forming large bubbles on the seal inner surface of the bag mouth of the packaging bag and/or creases on the seal part.

The packaging machine can remove fine bubbles generated on an inner side of the decorative seal with the result that perforations are formed.

The sealing method can reliably seal the packaging bag in a good-looking finish without forming large bubbles on the seal inner surface of the bag mouth of the packaging bag and/or creases on the seal part.

The sealing method can remove fine bubbles generated on an inner side of the decorative seal with the result that perforations are formed.

BEST MODE FOR CARRYING OUT THE INVENTION

The present invention realizes a packaging machine and a sealing method in the packaging machine, both of which execute a seal part preheating step of preheating a seal part of a packaging bag after the packaging bag has been filled with an article and steam deaeration has been carried out, a decorative seal applying step of applying a decorative seal to a part above the seal part of the packaging bag after the seal part preheating step, an ultrasonic seal applying step of applying an ultrasonic seal to a part below the seal part of the packaging bag after the decorative seal applying step, whereby the packaging bag can be reliably sealed in a good-looking finish without forming large bubbles on the seal inner surface of the bag mouth of the packaging bag and/or creases on the seal part.

Embodiment

Figure 1:
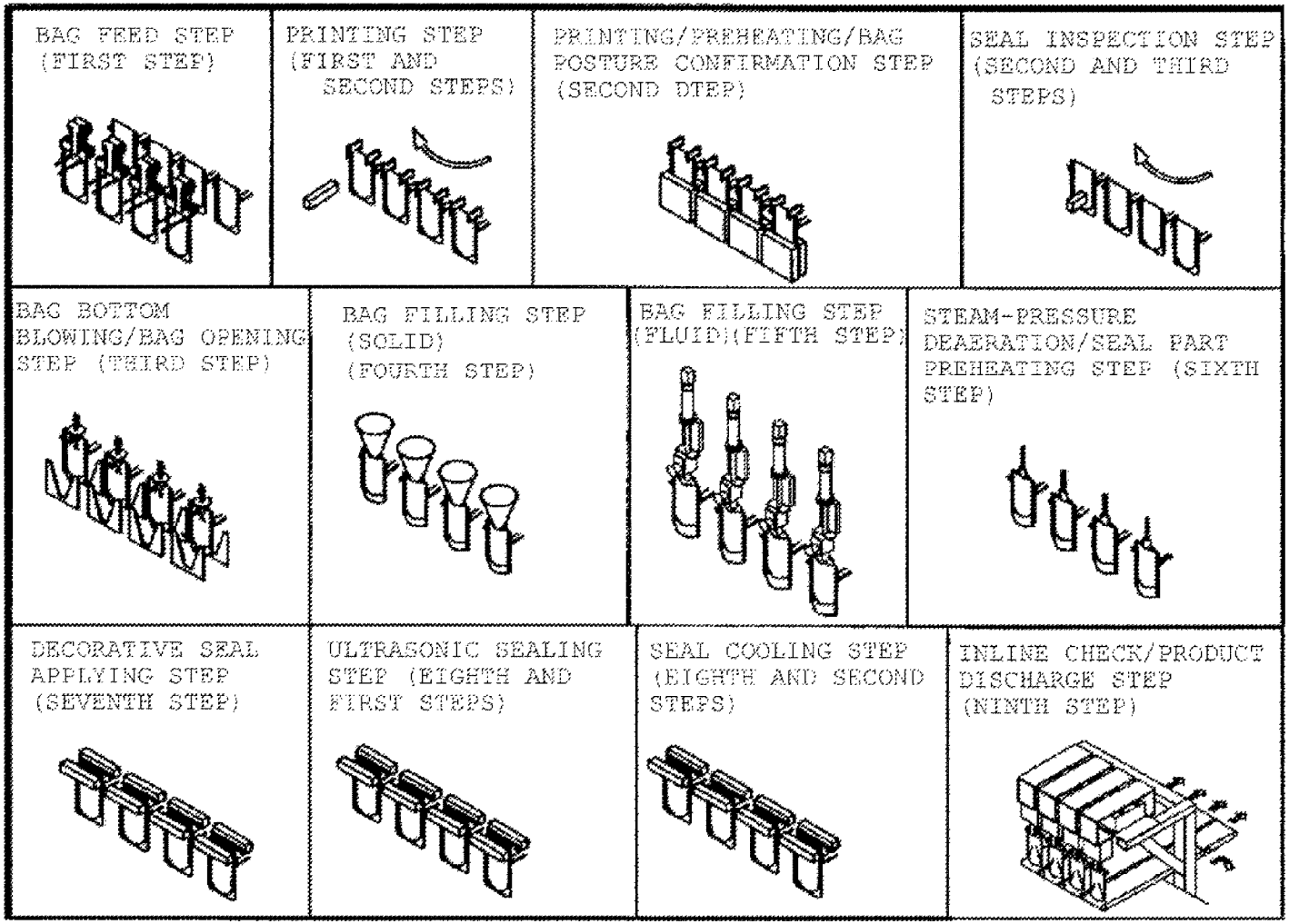
FIG. 1 is a process chart of the packaging manner of a packaging machine in accordance with the invention.
Figure 2:
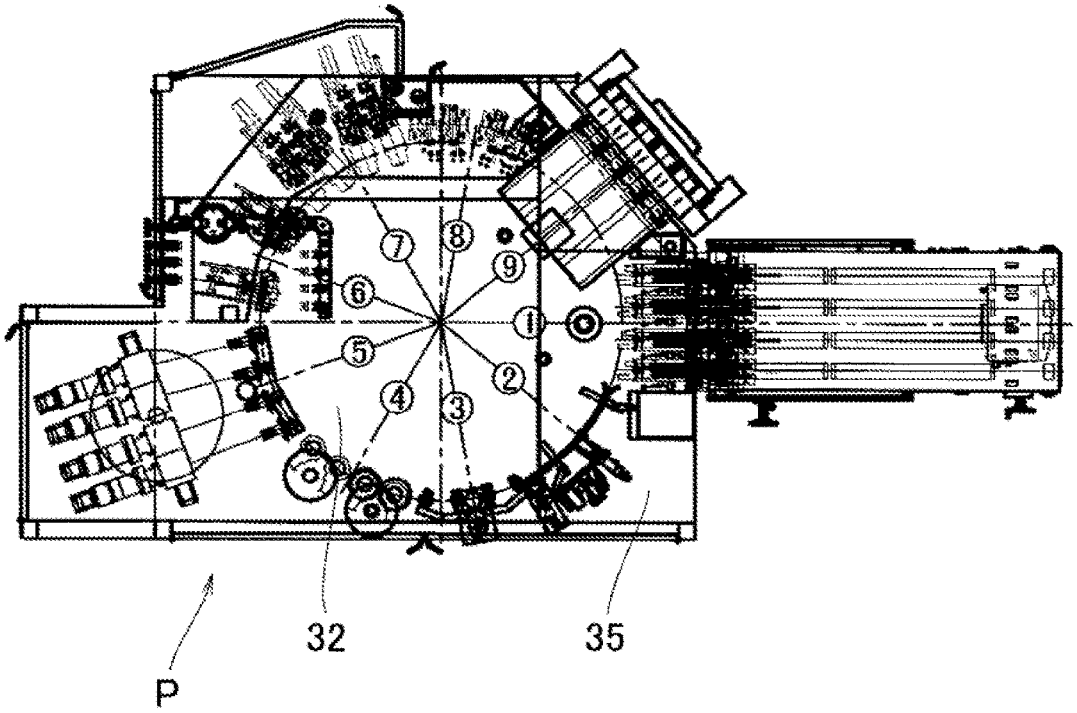
FIG. 2 is a plan view of the packaging machine.

An embodiment of the packaging machine in accordance with the present invention will be described with reference to FIGS. 1 to 8. As illustrated in FIGS. 1 and 2, the packaging machine P of the embodiment is a packaging machine in which grip pairs 31 respectively holding vicinities of both sides of a bag mouth of a packaging bag A are intermittently moved to each packaging station together with a mover 32, whereby an article to be packaged are packaged. The packaging machine P has a seal part preheating station 6 at which a seal part B of the packaging bag A is preheated after the packaging bag A has been filled with an article and steam deaeration has been carried out, a decorative seal applying station 7 which is provided downstream of the seal part preheating station 6 and at which a decorative seal D is applied to a part above the seal part B of the packaging bag A, and an ultrasonic seal applying station 8 which is provided downstream of the decorative seal applying station 7 and at which an ultrasonic seal C is applied to a part below the seal part B of the packaging bag A. The construction of the packaging machine P will be described in detail.

Figure 3:
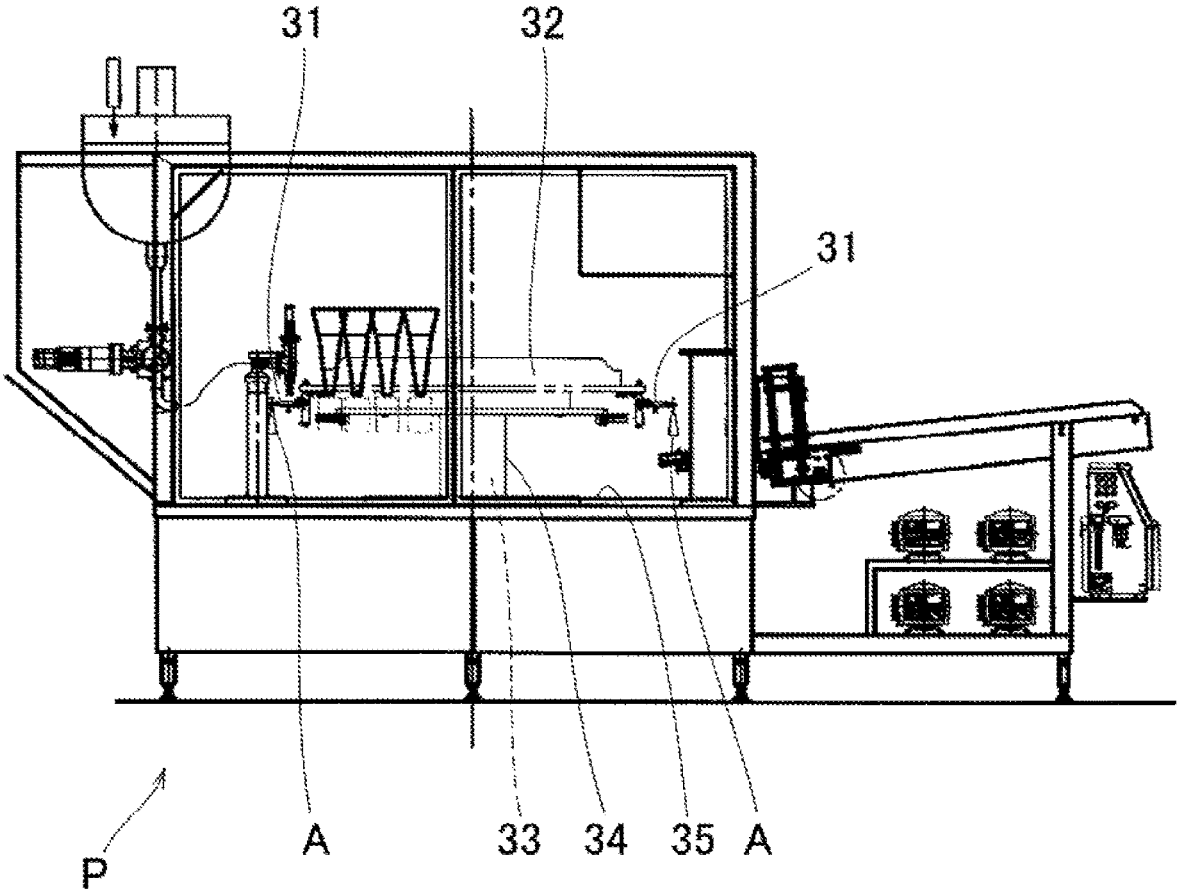
FIG. 3 is a front view of the packaging machine.
Figure 4:
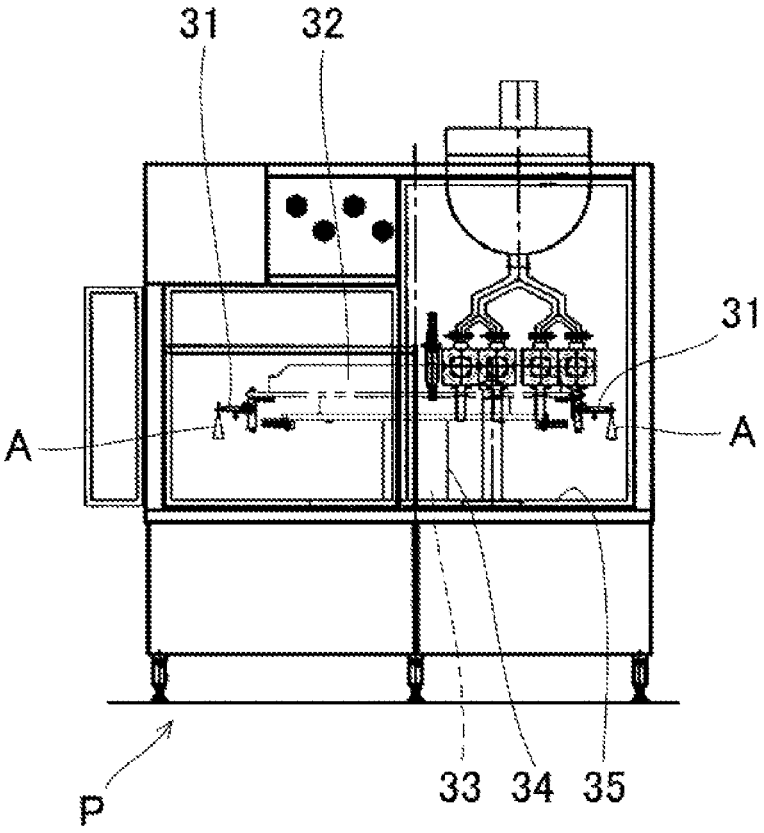
FIG. 4 is a left side view of the packaging machine.

The packaging machine P of the embodiment includes grip pairs 31 respectively holding vicinities of both sides of a bag mouth of the packaging bag A and a mover 32 intermittently moving the grip pairs 31 to each of a plurality of steps, as illustrated in FIGS. 3 and 4.

The packaging machine P is used for mass-producing retort food, and four packaging bags A respectively held by the grip pairs 31 are intermittently moved simultaneously to each of nine stations as illustrated in FIG. 2, during which movement retort food is mass-produced.

The packaging machine P includes a stand 34 rotatably supporting a vertically-extending intermittent rotating shaft 33 mounted on a machine base 35, as illustrated in FIGS. 3 and 4. The packaging machine P also includes a mover (a disk-shaped rotating body) 32 mounted on an upper part of the intermittent rotating shaft 33. Grip pairs 31 for gripping or releasing respective packaging bags A are provided on the mover 32 so as to project in a radiation direction at equiangular intervals about the intermittent rotating shaft 33. The grip pairs 31 are intermittently rotationally moved together with the mover 32 in every packaging process while respectively holding the vicinities of both sides of the bag mouths of the packaging bags A. Although a rotary packaging machine is used to intermittently rotating the mover (the disk-shaped rotating body) 32 in the embodiment, the invention may be applied to a known rectilinear movement type packaging machine.

The packaging machine P has a bag feed station 1, a printing/preheating/bag posture confirmation/seal inspection station 2, a bag bottom blowing/bag opening station 3, a bag filling station 4 (solids), a bag filling station 5 (fluids), a steam deaeration/seal part preheating station 6, a decorative seal applying station 7, an ultrasonic sealing station 8 and an inline check and product discharge station 9. The packaging process executed at each station will be described.

In the bag feed station 1, the packaging bags A sequentially conveyed by a bag feed conveyor are sequentially held by the intermittently moved grip pairs 31, so that the bag feed step (a first step) is carried out. More specifically, in the bag feed step (the first step), each packaging bag A, which is moved upward while being maintained in a vertical position by suckers, is held by a holding bar of a bag feed device to be transferred to the grip pairs 31 after correction of bag height.

In the printing/preheating/bag posture confirmation/seal inspection station 2, an expiration date or the like is printed by a sealing device (an ink-jet printer 70) on the reverse side of the packaging bag A supported in the vertical position by the grip pairs 31. Furthermore, the bottom vicinity of the packaging bag A is warmed from both sides of the packaging bag A by a warming device in order that the bottom of the packaging bag A may be opened (preliminary warming), and the position of the packaging bag A is confirmed (bag position confirmation). Still furthermore, a printed part is photographed by the camera 71 in order that printing may be checked to see if it is good or not (seal inspection).

In the bag bottom blowing/bag opening station 3, suckers are respectively caused to adhere to two sides of the packaging bag A supported in the vertical position by the grip pairs 31, in order that the bag mouth may be slightly opened, and thereafter, air is supplied into the packaging bag A so that the bag bottom is inflated.

In the bag filling station 4 (solid), a filling funnel is inserted through the bag mouth so that the packaging bag A is filled with an article (solid).

In the bag filling station 5 (fluid), a filling funnel is inserted through the bag mouth so that the packaging bag A is filled with an article (fluid).

Figure 5:
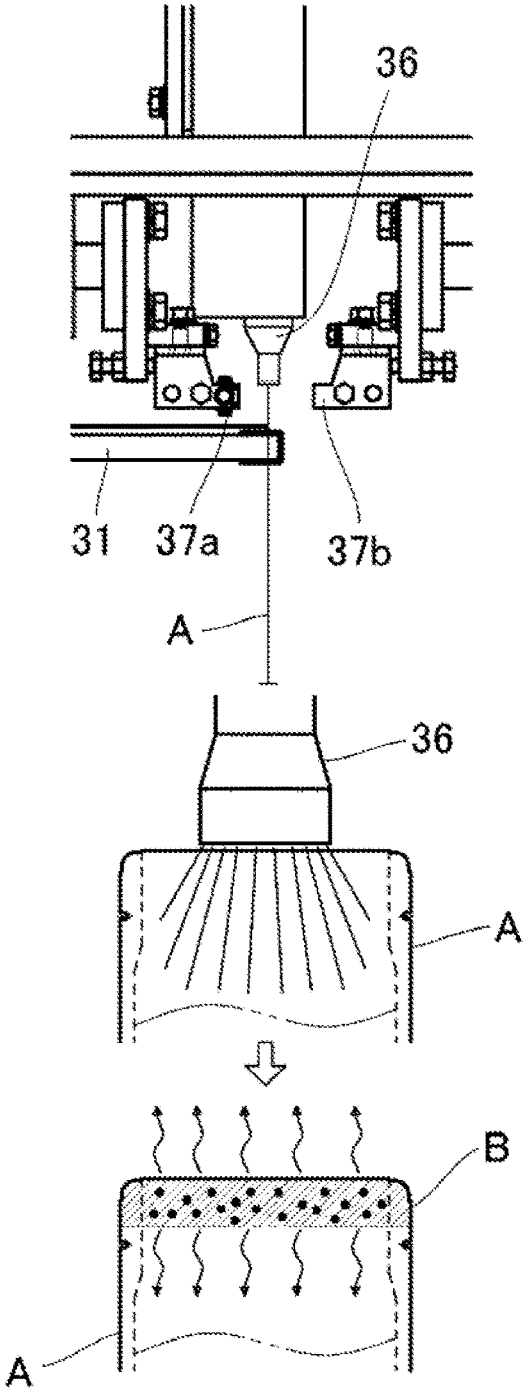
FIG. 5 is a diagrammatic view explaining an operation of the packaging machine at a seal part preheating station.

In the steam deaeration/seal part preheating station 6, the steam deaeration is executed and thereafter, a seal part B is previously heated so that water drops adhered to an inner side of the seal part B in the steam deaeration is vaporized thereby to be removed. More specifically, steam is discharged into the packaging bag A from a steam discharge nozzle of a steam deaerator, as illustrated in FIG. 5. As a result, air is driven out of the packaging bag A so that a storage period of retort food is prolonged, and the steam is liquefied so that the volume of inner space is reduced. Subsequently, the seal part B of the packaging bag A is clamped by paired pre-heating bars 37*a* and 37*b* from two sides of the packaging bag A, whereby the water drops adhered to the inner side of the seal part B is vaporized thereby to be removed.

Figure 6:
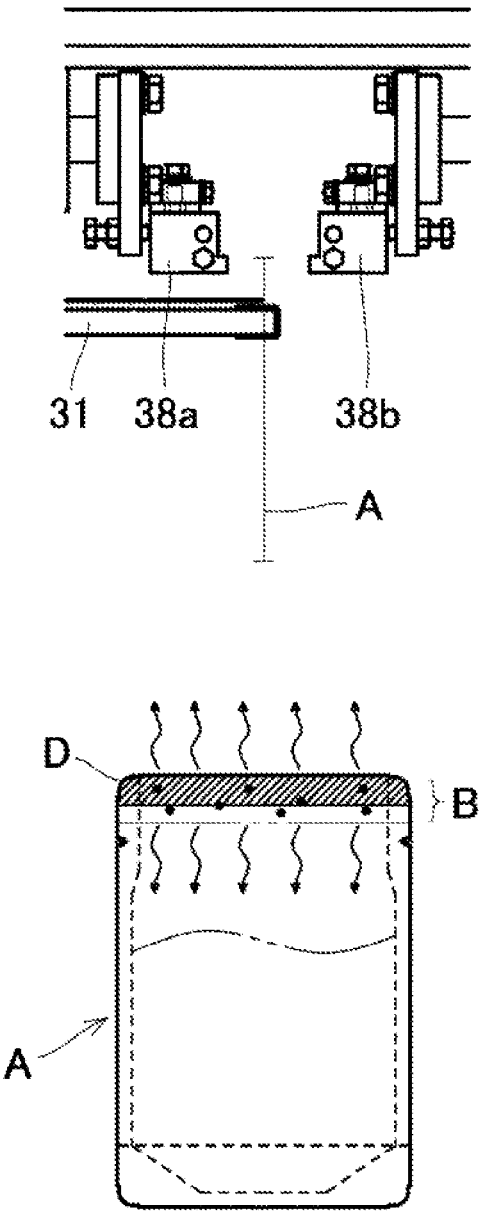
FIG. 6 is a diagrammatic view explaining an operation of the packaging machine at a decorative seal applying station.

In the decorative seal applying station 7, an upper part of the seal part B of the packaging bag A is clamped by paired sealing bars 38*a* and 38*b* from both sides of the packaging bag A with the result that a decorative seal (cosmetic seal) D is applied to the packaging bag A, as illustrated in FIG. 6. By applying the decorative seal D prior to the ultrasonic seal C, water droplets that could not be removed by the preheating of the seal part B are allowed to escape to the upper and lower sides (inside and outside of the packaging bag A), and large bubbles can be prevented from remaining on the inside of the seal and wrinkles can be prevented from occurring in the seal part.

Figure 7:
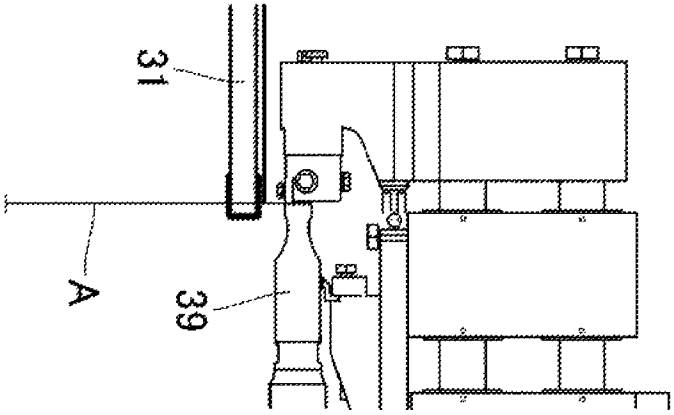
FIG. 7 is a diagrammatic view explaining an operation of the packaging machine at an ultrasonic seal applying station.
Figure 7:
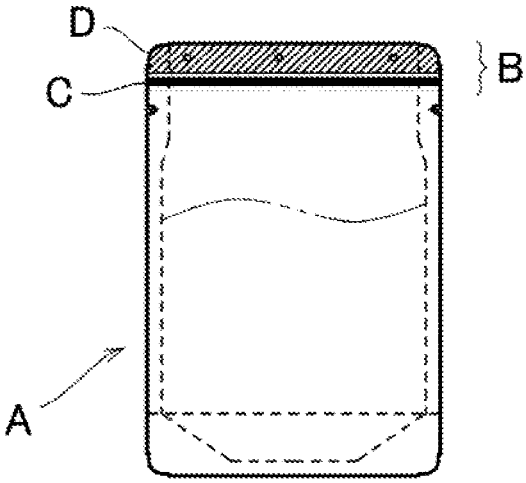
Figure 8:
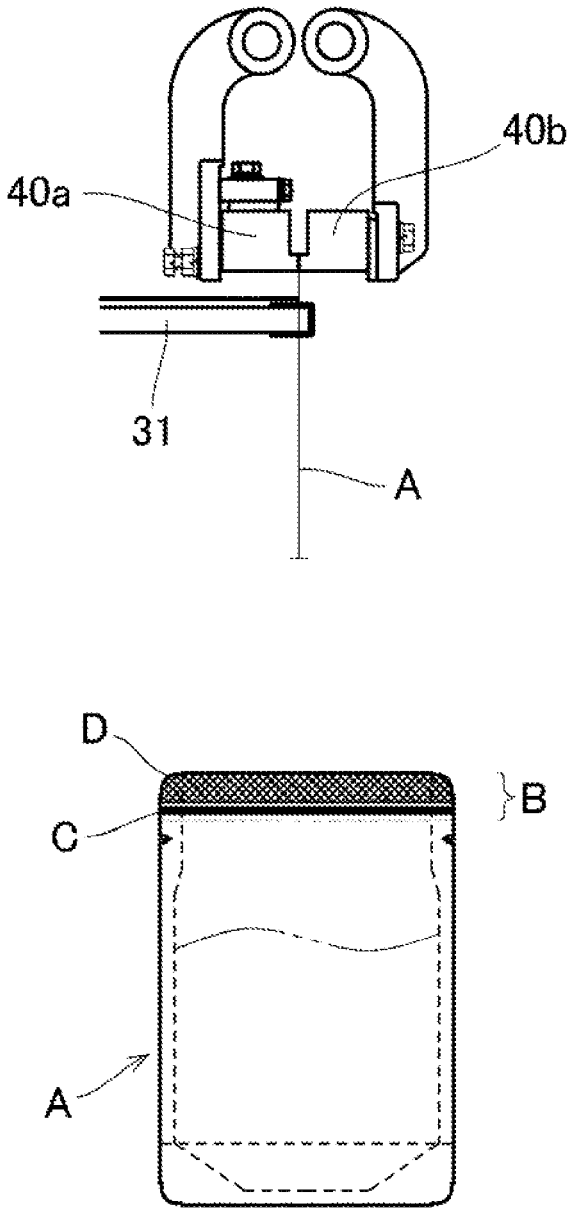
FIG. 8 is a diagrammatic view explaining another operation of the packaging machine at the decorative seal applying station.
Figure 9:
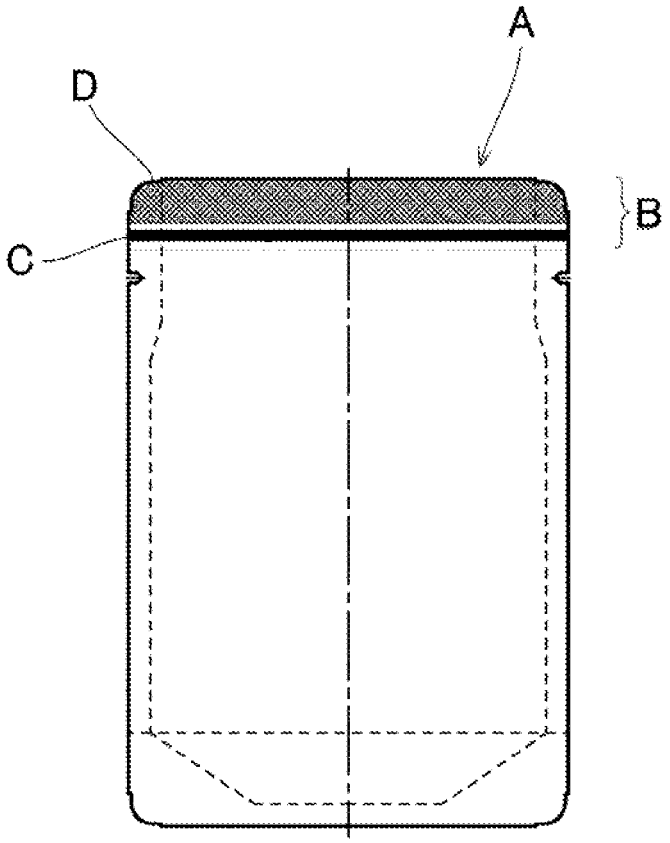
FIG. 9 is a diagrammatic view explaining a seal part of the packaging bag sealed by the packaging machine.

In the ultrasonic sealing station 8, a sealing horn 39 of an ultrasonic sealer is pressed against a lower part of the seal part B of the packaging bag A so that the ultrasonic seal C is applied to the packaging bag A with the result that the packaging bag A is completely sealed, as illustrated in FIG. 7. Subsequently, as illustrated in FIG. 8, the seal part B of the packaging bag A is held between paired cooling bars 40*a* and 40*b* from the outside and inside of the packaging bag A so that fine bubbles generated on the decorative seal D are removed by the cooling bars 40*a* and 40*b*, whereby perforations are formed. Although the seal cooling step is executed at the ultrasonic sealing station 8 in the embodiment, the invention encompasses a packaging machine having a seal cooling station for cooling the seal part downstream of the ultrasonic sealing station.

The invention thus realizes the packaging machine P which sequentially executes four steps including a seal part preheating step of preheating the seal part B of the packaging bag A after the packaging bag A has been filled with the article and steam deaeration has been carried out, a decorative seal applying step of applying a decorative seal D to a part above the seal part B of the packaging bag A after the seal part preheating step, an ultrasonic seal applying step of applying an ultrasonic seal C to a part below the seal part B of the packaging bag A after the decorative seal D applying step, and a cooling step, whereby the packaging bag A can be reliably sealed in a good-looking finish without forming large bubbles on the seal inner surface of the bag mouth of the packaging bag A and/or creases on the seal part B.

In the inline check/product discharge station 9, the weight of the packaging bag A in which the article is packaged is measured, and the packaging bag A in which a suitable amount of article is packaged is discharged via a sorting chute to an external conveyor. The packaging machine is configured so that the aforementioned sequential packaging process is carried out for the packaging bags A supported by the grip pairs 31 intermittently moved by the intermittent rotation of the mover 32 thereby to mass-produce packaged products of articles (retort food).

Next, the following will describe a packaging method (including a sealing method) in the packaging machine P in accordance with the invention.

In the packaging method in the packaging machine P of the embodiment, the grip pairs holding the vicinities of both sides of the bag mouth of the packaging bag A are intermittently moved to each of the packaging stations 1 to 9 together with the mover 32, so that the article is packaged in the packaging bag A. The packaging method includes a bag feed step (first step) of feeding the packaging bags A into the machine, a printing step (first and second steps), a preheating/bag posture confirmation step (second step), a seal inspection step (second and third steps), a bag bottom blowing/bag opening step (third step), a bag filling step (solid) (forth step), a bag filling step (fluid) (fifth step), a seal part preheating step (sixth step) of preheating the seal part B of the packaging bag A after the packaging bag A has been filled with the article and steam deaeration has been carried out, a decorative seal applying step (seventh step) of applying the decorative seal D to a part above the seal part B of the packaging bag A after the seal part preheating step, an ultrasonic seal applying step (eighth and first steps) of applying the ultrasonic seal C to a part below the seal part B of the packaging bag A after the decorative seal applying step, a cooling step (eighth and second steps) of cooling the seal part B of the packaging bag A after the ultrasonic sealing step, and an inline check/product discharge step (ninth step). The steps will be sequentially described. The description of the construction of the packaging machine P will be eliminated since it has been previously described.

In the bag feed step (the first step), the packaging bags A conveyed by a bag feed conveyor are sequentially held by the grip pairs 31 intermittently moved by the bag feed device, so that the bag feed step (a first step) is carried out at the bag feed station 1. More specifically, in the bag feed step (the first step), each packaging bag A, which is moved upward while being maintained in a vertical position by suckers, is held by a holding bar of a bag feed device to be transferred to the grip pairs 31 after correction of bag height.

In the printing step (the first and second steps), an expiration date or the like is printed at the printing/preheating/bag posture confirmation/seal inspection station 2 in FIG. 2 by a sealing device on the reverse side of the packaging bag A supported in the vertical position by the grip pairs 31.

In the preheating/bag posture confirmation step (the second step), at the printing/preheating/bag posture confirmation/seal inspection station 2 in FIG. 2, the bottom vicinity of the packaging bag A is warmed from both sides of the packaging bag A by a warming device in order that the bottom of the packaging bag A may be opened, and the position of the packaging bag A is confirmed.

In the seal inspection step (the second and third steps), a printed part is photographed by the camera 71 at the printing/preheating/bag posture confirmation/seal inspection station 2 in FIG. 2, in order that printing may be checked to see if it is good or not.

In the bag bottom blowing/bag opening step (the third step), at the bag bottom blowing/bag opening station 3 in FIG. 2, the suckers are respectively caused to adhere to two sides of the packaging bag A supported in the vertical position by the grip pairs 31, in order that the bag mouth may be slightly opened, and thereafter, air is supplied into the packaging bag A so that the bag bottom is inflated.

In the bag filling (solid) step (the fourth step), a filling funnel is inserted through the bag mouth at the bag filling station (solid) 4 in FIG. 2 so that the packaging bag A is filled with the article (the solid).

In the bag filling (fluid) step (the fourth step), a filling funnel is inserted through the bag mouth at the bag filling station (fluid) 4 in FIG. 2 so that the packaging bag A is filled with the article (fluid).

In the seal part preheating step (sixth step), the seal part B is previously heated after the packaging bag A has been filled with the article and the steam deaeration has been executed. In the seal part preheating step, the steam deaeration is executed and thereafter, the seal part B is previously heated at the steam deaeration/seal part preheating station 6 in FIG. 2 so that water drops adhered to an inner side of the seal part B in the steam deaeration is vaporized thereby to be removed.

More specifically, steam is discharged into the packaging bag A from a steam discharge nozzle 36 of a steam deaerator in this step, as illustrated in FIG. 5. As a result, air is driven out of the packaging bag A so that a storage period of retort food is prolonged, and the steam is liquefied so that the volume of inner space is reduced. Subsequently, the seal part B of the packaging bag A is clamped by the paired preheating bars 37*a* and 37*b* from two sides of the packaging bag A, whereby the water drops adhered to the inner side of the seal part B is vaporized thereby to be removed.

In the decorative seal applying step, an upper part of the seal part B of the packaging bag A is clamped by the paired sealing bars 38*a* and 38*b* from both sides of the packaging bag A at the decorative seal applying station in FIG. 2, with the result that a decorative seal (cosmetic seal) D (refer to FIG. 7) is applied to the packaging bag A, as illustrated in FIG. 6. Since the decorative seal D is applied prior to the ultrasonic seal C in the packaging machine P, water droplets that could not be removed by the preheating of the seal part B are allowed to escape to the upper and lower sides (inside and outside of the packaging bag A), and large bubbles can be prevented from remaining on the inside of the seal and wrinkles can be prevented from occurring in the seal part.

In the ultrasonic sealing step (eighth and first steps), a sealing horn of an ultrasonic sealer is pressed against a lower part of the seal part B of the packaging bag A at the ultrasonic sealing station 8 in FIG. 2 so that the ultrasonic seal C is applied to the packaging bag A with the result that the packaging bag A is completely sealed, as illustrated in FIG. 7. Subsequently, the seal part B of the packaging bag A is held between the paired cooling bars 40*a* and 40*b* from the outside and inside of the packaging bag A so that fine bubbles generated on the decorative seal D are removed by the cooling bars, whereby perforations are formed (seal cooling step (eighth and second steps). Although the seal cooling step is executed at the ultrasonic sealing station 8 in the embodiment, the invention encompasses a packaging machine having a seal cooling station for cooling the seal part downstream of the ultrasonic sealing station.

Thus, the sealing method in the packaging machine P of the embodiment includes the sequentially executed four steps, that is, the seal part preheating step of preheating the seal part B after the packaging bag A has been filled with the article and the steam deaeration has been carried out, the decorative seal applying step of applying the decorative seal D to the part of the packaging bag A above the seal part B after the seal part preheating step, the ultrasonic sealing step of applying the ultrasonic seal C to the part of the packaging bag A below the seal part B, and the seal cooling step, whereby the packaging bag A can be reliably sealed in a good-looking finish without forming large bubbles on the seal inner surface of the bag mouth of the packaging bag and/or creases on the seal part.

In the inline check/product discharge step (ninth step), the weight of the packaging bag A in which the article is packaged is measured, and the packaging bag A in which a suitable amount of article is packaged is discharged via a sorting chute to an external conveyor. The rotary packaging machine P is configured so that the aforementioned sequential packaging process is carried out for the packaging bags A supported by the grip pairs 31 intermittently moved by the intermittent rotation of the disk-shaped rotating body 32 thereby to mass-produce packaged products of articles (retort food).

EXPLANATION OF REFERENCE SYMBOLS

P packaging machine
1 bag feed station
2 printing/preheating/bag posture confirmation/seal inspection station
3 bag bottom blowing/bag opening station
4 bag filling station (solid)
5 bag filling station (fluid)
6 steam deaeration/seal part preheating station
7 decorative seal applying station
8 ultrasonic sealing station
9 inline check/product discharge station
31 grip pair
32 mover (disk-shaped rotating body)
33 intermittent rotating shaft
34 stand
35 machine base
36 steam discharge nozzle
37*a* and 37*b* preheating bars
38*a* and 38*b* sealing bars
39 sealing horn
40*a* and 40*b* cooling bars
A packaging bag
B seal part
C ultrasonic seal
D decorative seal

The invention claimed is:

1. A packaging machine in which a packaging bag is intermittently moved to each packaging station together with a mover so that an article is packaged, the packaging machine comprising:

a steam deaeration and seal part preheating station
for steam deaeration and
for preheating a seal part of the packaging bag after the packaging bag has been filled with the article so as to vaporize water drops adhered to an inner side of the seal part during steam deaeration;

a decorative seal applying station provided downstream of the seal part preheating station for applying a decorative seal to a part of the packaging bag across an upper portion of the seal part; and an ultrasonic seal applying station provided downstream of the decorative seal applying station for applying an ultrasonic seal to a part of the packaging bag across a lower portion of the seal part and below the decorative seal.

2. The packaging machine according to claim 1, further comprising a cooling station provided downstream of the ultrasonic seal applying station for cooling the seal part of the packaging bag.

3. The packaging machine according to claim 1, wherein the steam deaeration and seal part preheating station has a steam deaerator for steam deaeration and has paired preheating bars for preheating, and the decorative seal applying station has paired sealing bars.

4. A sealing method in a packaging machine in which a packaging bag is intermittently moved to each packaging station together with a mover so that an article is packaged, the sealing method comprising:

a filling step of filling the packaging bag with the article;

a steam deaerating step of deaeration by liquified steam;

a seal part preheating step of preheating a seal part of the packaging bag and vaporizing and removing water drops adhered to an inner side of the seal part created by the steam deaerating step;

a decorative seal applying step of applying a decorative seal to a part of the packaging bag across an upper portion of the seal part after the seal part preheating step, and allowing to escape water drops not removed by the seal part preheating step and preventing from occurring large bubbles and wrinkles in the seal part; and an ultrasonic seal applying step of applying an ultrasonic seal to a part of the packaging bag across a lower portion of the seal part and below the decorative seal after the decorative seal applying step.

5. The sealing method according to claim 4, further comprising a cooling step of cooling the seal part of the packaging bag after the ultrasonic seal applying step.

* * * * *